US009429882B2

(12) United States Patent
Yamazaki

(10) Patent No.: US 9,429,882 B2
(45) Date of Patent: Aug. 30, 2016

(54) IMAGE FORMING APPARATUS AND IMAGE FORMING METHOD

(71) Applicants: CITIZEN HOLDINGS CO., LTD., Tokyo (JP); CITIZEN SYSTEMS JAPAN CO., LTD., Tokyo (JP)

(72) Inventor: Takeshi Yamazaki, Nagano (JP)

(73) Assignees: CITIZEN HOLDINGS CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 14/783,057

(22) PCT Filed: Jan. 7, 2015

(86) PCT No.: PCT/JP2015/050269

§ 371 (c)(1),
(2) Date: Oct. 7, 2015

(87) PCT Pub. No.: WO2015/151538

PCT Pub. Date: Oct. 8, 2015

(65) Prior Publication Data

US 2016/0070211 A1 Mar. 10, 2016

(30) Foreign Application Priority Data

Mar. 31, 2014 (JP) ..... 2014-073205

(51) Int. Cl.
*B41J 2/325* (2006.01)
*B41J 2/355* (2006.01)
(Continued)

(52) U.S. Cl.
CPC ..... *G03G 15/1605* (2013.01); *B41J 2/325* (2013.01); *B41J 2/355* (2013.01); *B41J 2/36* (2013.01); *B41J 31/14* (2013.01)

(58) Field of Classification Search
CPC ..... B41J 2/315; B41J 2/32; B41J 3/325; B41J 3/355; B41J 3/36; B41J 3/385; B41J 31/00–31/16
See application file for complete search history.

(56) References Cited

U.S. PATENT DOCUMENTS

2002/0181989 A1* 12/2002 Kobayashi ..... B41J 2/325 400/120.01
2004/0075730 A1* 4/2004 Tsuruta ..... B41J 2/325 347/171

(Continued)

FOREIGN PATENT DOCUMENTS

EP 2664459 A1 11/2013
JP H04-148944 A 5/1992

(Continued)

OTHER PUBLICATIONS

Sugiyama, MachineTranslationofJP 06143720 A, 1994.*

(Continued)

*Primary Examiner* — Geoffrey Mruk
*Assistant Examiner* — Scott A Richmond

(57) ABSTRACT

Damage caused to a transfer medium due to heat when partially using transfer material regions is suppressed. An image forming apparatus (1) includes a transporting unit (4A, 4B) which transports a belt-like transfer medium (4) on which transfer material regions (Y, M, C, OP) of a first size respectively corresponding to transfer materials are arranged in a predetermined order in a repeated manner along a longitudinal direction thereof, and an image forming unit (3) which transfers the transfer materials in sequence by heating the respective transfer material regions and thereby forms on a recording medium an image with the first size or an image with a second size which is not larger than one half the first size. When forming an image with the second size, the image forming unit either uses unused portions of transfer material regions that have already been used to form an image with the second size or uses new transfer material regions on the transfer medium. When forming the image with the second size by using the new transfer material regions, the image forming unit performs the image formation at a slower speed than when forming an image with the first size.

5 Claims, 5 Drawing Sheets

(51) Int. Cl.

| | |
|---|---|
| ***B41J 2/36*** | (2006.01) |
| ***B41J 31/14*** | (2006.01) |
| ***G03G 15/16*** | (2006.01) |

(56) References Cited

U.S. PATENT DOCUMENTS

| | | | |
|---|---|---|---|
| 2006/0181598 | A1 | 8/2006 | Mindler et al. |
| 2008/0012928 | A1 | 1/2008 | Sparer |
| 2013/0182059 | A1 | 7/2013 | Terauchi et al. |
| 2013/0286139 | A1 | 10/2013 | Furuki et al. |

FOREIGN PATENT DOCUMENTS

| | | | | |
|---|---|---|---|---|
| JP | H04-348982 | A | | 12/1992 |
| JP | H06-031954 | A | | 2/1994 |
| JP | 06143720 | A | * | 5/1994 |
| JP | H06-143720 | A | | 5/1994 |
| JP | H11-245493 | A | | 9/1999 |
| JP | 2004-202941 | A | | 7/2004 |
| JP | 2007-038442 | A | | 2/2007 |
| JP | 2007-090798 | A | | 4/2007 |
| JP | 2007-196575 | A | | 8/2007 |
| JP | 2013-144398 | A | | 7/2013 |
| WO | 2008/008188 | A2 | | 1/2008 |

OTHER PUBLICATIONS

Japan Patent Office, Office Action for Japanese Patent Application No. 2014-073205, Mar. 17, 2015.

European Patent Office, Extended European Search Report for EP Patent Application No. 15774377.4, Jul. 1, 2016.

* cited by examiner

IMAGE FORMING APPARATUS AND IMAGE FORMING METHOD

TECHNICAL FIELD

The present invention relates to an image forming apparatus and an image forming method.

BACKGROUND ART

An image forming apparatus is known which forms an image on a recording medium by transferring transfer materials in sequence from a plurality of transfer material regions that are formed on a belt-like transfer medium in a repeated manner along its longitudinal direction. Specifically, an image forming apparatus is known which, after forming an image with a size not larger than one half the transfer material region size by partially using each of the transfer material regions, can form a new image with the same size by rewinding the transfer medium and using the unused portions of the partially used transfer material regions.

For example, patent document 1 discloses a thermal transfer color printer which, when performing L-size printing by using a 2L-size ink ribbon, uses the ink ribbon in the reverse direction starting from the end of each ink region of the ink ribbon (in the rewinding direction of the ink ribbon), rather than in the usual forward direction starting from the beginning of each ink (in the winding direction of the ink ribbon).

On the other hand, patent document 2 discloses a printer which has the capability to print a plurality of images smaller in size than the surface of an ink layer of an ink ribbon, and which, based on the average grayscale value of the previously printed image, assesses the magnitude of thermal damage that the ink ribbon suffered and, when printing the next image, performs control by determining whether to rewind the ink ribbon and use the remaining unused portions or to use new portions of the ink ribbon.

PRIOR ART DOCUMENTS

Patent Documents

Patent Document 1: Japanese Unexamined Patent Publication No. 2004-202941

Patent Document 2: Japanese Unexamined Patent Publication No. 2007-090798

SUMMARY

In the case of an image forming apparatus such as a sublimation printer or a thermal fusion printer, a transfer medium such as an ink ribbon suffers damage due to the heat applied to transfer a transfer material to the recording medium. In particular, as the density of the formed image increases, the magnitude of the damage increases, causing the transfer medium to elongate. If such an elongated transfer medium is rewound, and a new image is formed by using the unused portions of the partially used transfer material regions, creases may occur in the transfer medium in portions where the transfer materials dropped out, and the quality of the formed image may be impaired due to the creases.

Accordingly, it is an object of the present invention to suppress the damage that may be caused to the transfer medium due to heat when partially using transfer material regions.

An image forming apparatus includes a transporting unit which transports a belt-like transfer medium on which a plurality of transfer material regions of a first size respectively corresponding to a plurality of transfer materials are arranged in a predetermined order in a repeated manner along a longitudinal direction thereof, and an image forming unit which transfers the transfer materials in sequence by heating the respective transfer material regions and thereby forms on a recording medium an image with the first size or an image with a second size which is not larger than one half the first size, wherein when forming an image with the second size, the image forming unit either uses unused portions of transfer material regions that have already been used to form an image with the second size or uses new transfer material regions on the transfer medium, and when forming the image with the second size by using the new transfer material regions, the image forming unit performs the image formation at a slower speed than when forming an image with the first size.

Preferably, in the above image forming apparatus, when forming the image with the second size by using the unused portions of the transfer material regions that have already been used to form an image with the second size, the image forming unit performs the image formation either at the same speed as when forming an image with the first size or at the same speed as when forming the image with the second size by using the new transfer material regions.

Preferably, in the above image forming apparatus, when forming the image with the second size at a slower speed than when forming an image with the first size, the image forming unit heats each of the transfer material regions at a lower temperature than when forming an image with the first size.

Preferably, in the above image forming apparatus, when forming the image with the second size, the image forming unit applies the same amount of heat per unit area to each of the transfer material regions as when forming an image with the first size.

Preferably, in the above image forming apparatus, when forming the image with the second size by using the new transfer material regions, the image forming unit uses a first half portion of each of the transfer material regions as viewed along a transport direction of the transfer medium.

An image forming method includes a transporting step for transporting a belt-like transfer medium on which a plurality of transfer material regions of a first size respectively corresponding to a plurality of transfer materials are arranged in a predetermined order in a repeated manner along a longitudinal direction thereof, and an image forming step for transferring the transfer materials in sequence by heating the respective transfer material regions and thereby forming on a recording medium an image with the first size or an image with a second size which is not larger than one half the first size, wherein in the image forming step, when forming an image with the second size, the image is formed either using unused portions of transfer material regions that have already been used to form an image with the second size or using new transfer material regions on the transfer medium, and when forming the image with the second size by using the new transfer material regions, the image formation is performed at a slower speed than when forming an image with the first size.

The above image forming apparatus and image forming method can suppress the damage that may be caused to the transfer medium due to heat when partially using transfer material regions.

DESCRIPTION

Hereinafter, with reference to the drawings, an image forming apparatus and an image forming method will be explained in detail. However, it should be noted that the technical scope of the present invention is not limited to embodiments thereof and includes the invention described in claims and equivalents thereof.

Figure 1:
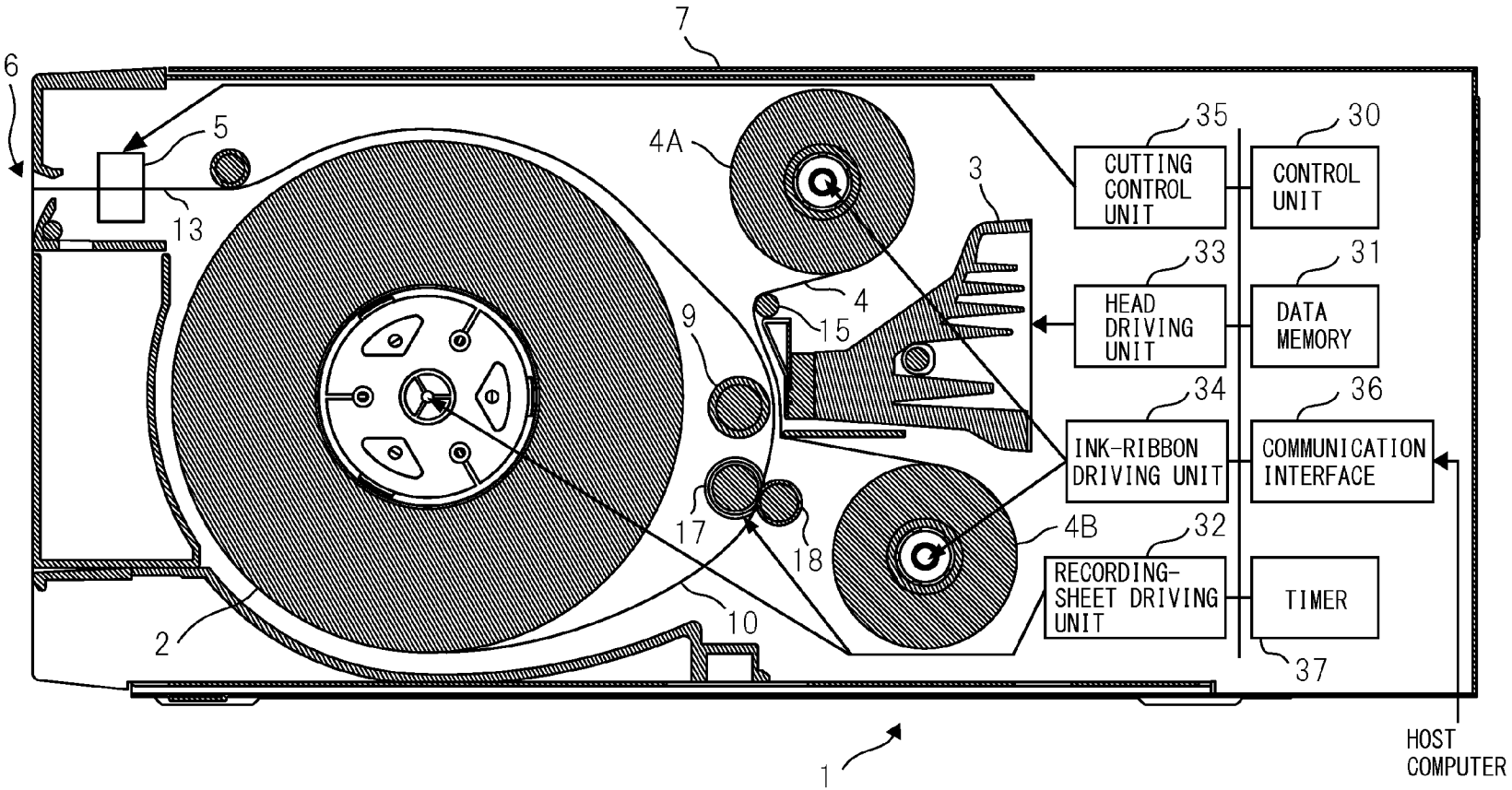
FIG. 1 is a diagram for explaining the basic construction of a printer 1.

FIG. 1 is a diagram for explaining the basic construction of a printer 1. In FIG. 1, of the various component elements constituting the printer 1, only those indispensable for explanation are shown, and the other component elements are omitted from illustration.

The printer 1 (one example of an image forming apparatus) is a printer that forms an image with a plurality of colors, for example, yellow, magenta, and cyan, by moving a rolled recording sheet (one example of a recording medium) in reciprocating fashion relative to a head and thereby performing image formation on the same area of the recording sheet a plurality of times. Image formation may hereinafter be referred to as "image printing".

In the printer 1, the rolled recording sheet 10 is held on a roll paper holder 2, and an image is formed on a recording surface of the recording sheet 10 unwound from the roll paper holder 2. To hold the rolled recording sheet 10 on the roll paper holder 2, the center axis of the rolled recording sheet 10, for example, is rotatably supported by the roll paper holder 2. In this way, the recording sheet 10 is rotatably mounted on the roll paper holder 2.

Image formation is performed by transferring an ink to a prescribed position on the recording surface of the recording sheet 10 by means of the head 3 while pressing an ink ribbon 4 (one example of a transfer medium) onto the recording surface. In this case, the ink ribbon 4 and the recording sheet 10 are transported with one overlaid on the other while passing between the head 3 and a platen roller 9. The head 3 is mounted so as to be movable relative to the platen roller 9, and during image formation, the head 3 is pressed against the platen roller 9 in a contacting relationship therewith. The printer 1 forms an image by heating the heating elements of the head 3 in a desired pattern thereby transferring the desired image from the ink ribbon 4 onto the recording sheet 10.

To form a multicolor image, the ink ribbon 4, on which ink regions of yellow, magenta, and cyan (examples of transfer materials) corresponding to the colors of the image to be formed are arranged in a designated order along the winding direction of the ink ribbon 4, is moved so that the designated ink region is moved past the head 3 while the ink ribbon 4 is being wound; this operation is repeated for each color. The ink ribbon 4 is supplied from a ribbon supply roller 4A and wound onto a ribbon take-up roller 4B. These rollers may hereinafter be referred to simply as the "ribbon rollers 4A and 4B", respectively. The ink ribbon 4 is guided by a ribbon guide roller 15 provided between the ribbon supply roller 4A and the head 3 and a ribbon guide portion 16 (see FIG. 2(A)) formed integrally with the head 3.

In the image formation of each color, the recording sheet 10 is first fed (unwound) past the position of the head 3 by an amount equal to the length of the image to be formed, and then the recording sheet 10 is rewound. The image formation is performed by the head 3 during the rewinding process of the recording sheet 10. In the printer 1, the recording sheet 10 is moved in reciprocating fashion in order to overlay images of different colors on the same image forming area on the recording sheet 10. A grip roller 17 and a pinch roller 18 are provided in the transport path of the recording sheet 10 to effect the reciprocating movement of the recording sheet 10. The unwinding and rewinding of the recording sheet 10 is repeatedly performed by changing the rotating direction of the roll paper holder 2 according to the transporting direction of the recording sheet 10 being transported by these rollers. When no image formation is performed, the pinch roller 18 is separated from the grip roller 17 to release the recording sheet 10. On the other hand, when image forming is performed, the pinch roller 18 is pressed against the grip roller 17 to transport the recording sheet 10 in the desired direction. In this way, the printer 1 performs image formation a plurality of times on the same image forming area on the recording sheet 10 by reciprocating the recording sheet 10 relative to the head 3.

The ink ribbon 4 is provided with an overcoat layer (one example of a transfer material) in addition to the ink regions of yellow, magenta, and cyan. After completing the formation of images of the respective colors, the recording surface of the recording sheet 10 is covered with the overcoat layer for protection.

The printer 1 is provided with a recording-sheet cutting unit 5 in an exit path 13 at a position just before an exit port 6. After completing the image formation, the recording sheet 10 that moved past the head 3 is transported through the exit path 13 and discharged outside the printer through the exit port 6 formed in a cabinet 7 of the printer 1. The recording sheet 10 discharged outside through the exit port 6 is cut at the position just before the exit port 6 by means of the recording-sheet cutting unit 5. The thus cut recording sheet 10 comes out of the exit port 6.

The printer 1 further includes a control unit 30, a data memory 31, a recording-sheet driving unit 32, a head driving unit 33, an ink-ribbon driving unit 34, a cutting control unit 35, a communication interface 36, and a timer 37.

The control unit 30 controls the entire operation of the printer 1. The control unit 30 includes a CPU, RAM, ROM, etc., and carries out an image forming process as will be described later by loading a program prestored in the ROM into the RAM for execution. The data memory 31 is a storage area for storing image data received via the communication interface 36 from a host computer.

The recording-sheet driving unit 32 drives the recording sheet 10 by holding it between the grip roller 17 and the pinch roller 18. More specifically, the recording-sheet driving unit 32 feeds the recording sheet 10 by rotationally driving the grip roller 17 and the roll paper holder 2. Further, the recording-sheet driving unit 32 rewinds the thus fed recording sheet 10 by rotationally driving the grip roller 17 and the roll paper holder 2 in the reverse direction. The printer 1 forms an image on the recording sheet 10 while the thus fed recording sheet 10 is being rewound.

The head driving unit 33 drives the head 3 based on image data and forms an image on the recording sheet 10. For the head 3, a mechanism can be used that matches any kind of image forming method such as one used in a sublimation printer or a thermal fusion printer. In the printer 1, the head 3, the platen roller 9, and the head driving unit 33 are together provided as one example of an image forming unit for forming an image on a recording medium.

The ink-ribbon driving unit 34 drives the ribbon supply roller 4A and the ribbon take-up roller 4B and moves the ink ribbon 4 relative to the head 3 in synchronism with the driving of the head 3. The ink-ribbon driving unit 34 further includes a rewinding mechanism for the ink ribbon 4, and can drive the ink ribbon 4 in the rewinding direction which is opposite to the winding direction (forward direction). In the printer 1, the ribbon rollers 4A and 4B and the ink-ribbon driving unit 34 are together provided as one example of a transporting unit for transporting a belt-like transfer medium.

The cutting control unit 35 controls the recording-sheet cutting unit 5 so that the recorded area of the recording sheet 10 is cut at its trailing end and separated in the form of a single sheet when the recording sheet 10 transported along the exit path 13 is discharged outside through the exit port 6.

The communication interface 36 transfers data to and from the host computer via a communication cable. The timer 37 measures elapsed time in order to perform processing to form, when data for two images each smaller in size than the ink region size of the ink ribbon 4, for example, are received successively from the host computer within a predefined time period, the images by mapping the data for the two images to the same ink region.

Figure 2:
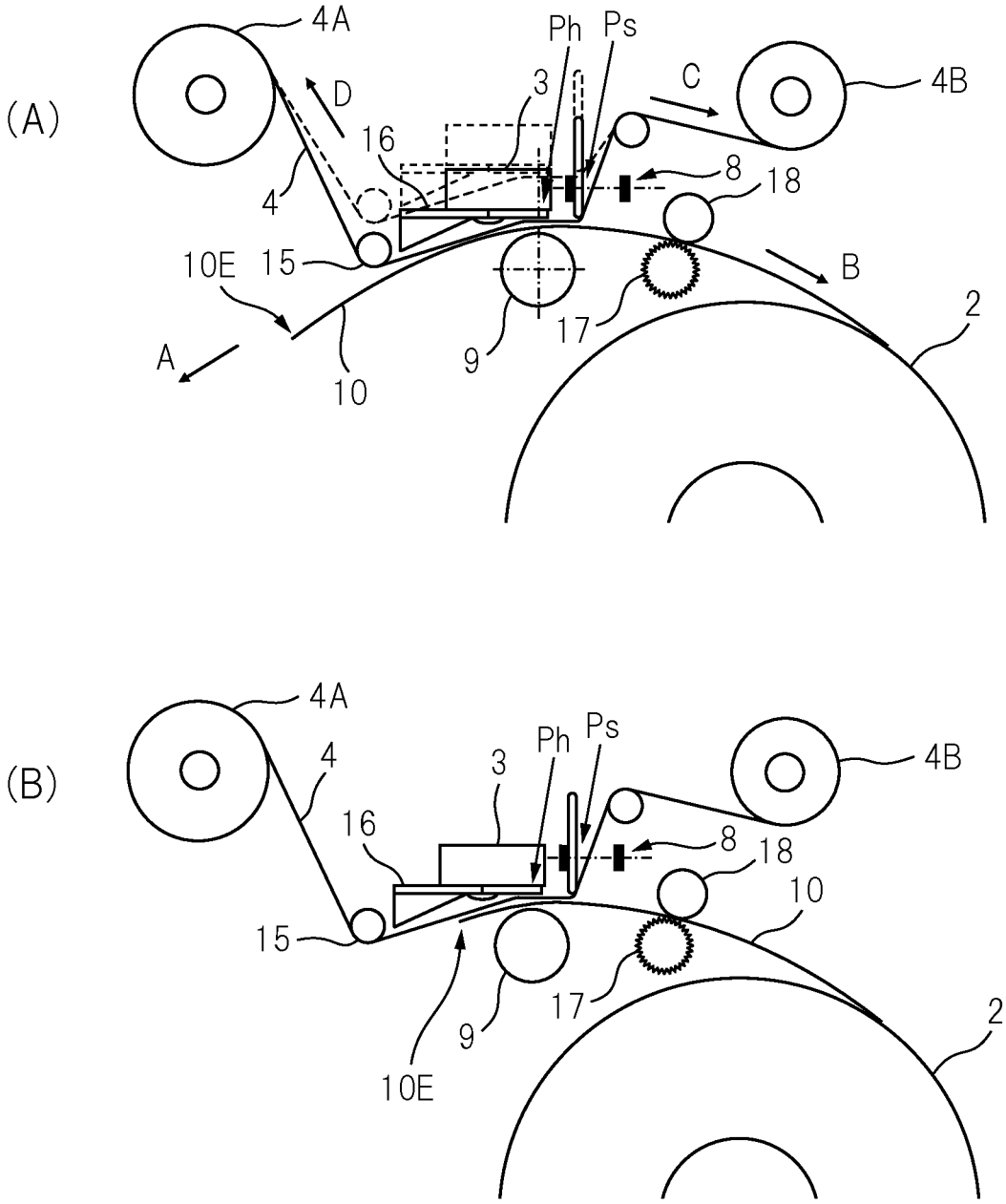
FIGS. 2(A) and (B) are diagrams showing in enlarged form a portion in the vicinity of the head 3 in FIG. 1.

FIGS. 2(A) and 2(B) are diagrams showing in enlarged form a portion in the vicinity of the head 3 in FIG. 1. FIG. 2(A) shows the positional relationship between the head 3 and the recording sheet 10 when image formation for one color begins. On the other hand, FIG. 2(B) shows the positional relationship between the head 3 and the recording sheet 10 when image formation for one color ends. In FIG. 2(A), the position of the head 3 during image formation is indicated by a solid line, and the position of the head 3 when image formation is not performed is indicated by a dashed line, the respective positions being shown one overlaid on the other in the same diagram.

As shown in FIG. 2(A), when image formation for one color begins, first the recording sheet 10 is fed in the direction of arrow A by an amount equal to the length of the image forming area on the recording sheet 10, and the edge 10E of the recording sheet 10 is located at the left in the figure. For example, when image formation for yellow begins, the beginning of the yellow ink region and the beginning of the image forming area on the recording sheet 10 are both aligned with the position Ph where the head 3 forms an image. The position where the head 3 forms an image in the transport path of the ink ribbon 4 will hereinafter be referred to as the "head position Ph". With the ink ribbon 4 overlaid on the recording sheet 10 at the head position Ph, image formation for yellow is performed on the recording sheet 10 by the head 3 while the recording sheet 10 is being transported in the direction of arrow B and the ink ribbon 4 in the direction of arrow C.

When the image formation for yellow ends, reaching the condition shown in FIG. 2(B), the recording sheet 10 is again fed in the direction of arrow A. The recording sheet 10 is again positioned relative to the head 3, as shown in FIG. 2(A). Then, the beginning of the next magenta ink region and the beginning of the image forming area on the recording sheet 10 are both aligned with the head position Ph, and image formation for magenta is performed. In this way, by moving the recording sheet 10 left and right in the figure, image formation is performed for yellow, magenta, and cyan, followed by the application of an overcoat. After that, the recording sheet 10 is fed in the direction of arrow A, is cut at the image trailing end by the recording-sheet cutting unit 5, and is discharged outside.

The ink ribbon 4 is transported in the direction of arrow C when it is wound on the ribbon take-up roller 4B, and in the direction of arrow D when it is rewound on the ribbon supply roller 4A. The direction of arrow C and the direction of arrow D correspond to the winding direction and the rewinding direction, respectively. In the case of the ink ribbon 4, the direction of arrow C from the ribbon supply roller 4A to the ribbon take-up roller 4B is the direction from the upstream to the downstream. This direction is opposite to the direction of arrow A in which the recording sheet 10 is moved past the head 3 and platen roller 9 and transported through the exit path 13 toward the exit.

In the printer 1, a ribbon sensor 8 for sensing the boundary between each ink region on the ink ribbon 4 coated with the yellow, magenta, and cyan inks as well as the overcoat is disposed downstream of the head 3 as viewed in the winding direction of the ink ribbon 4. The ribbon sensor 8 is one example of a sensing unit for sensing the boundary between each transfer material region. When image printing for each color ends, and the ink ribbon 4 is further wound, the ribbon sensor senses the next region boundary. In the following description, the ink regions and the overcoat region (examples of transfer material regions) are each referred to as a "panel", and the boundary between each panel is referred to as the "panel boundary". The position Ps (sensing position) at which the ribbon sensor 8 is disposed in the transport path of the ink ribbon 4 is referred to as the "sensor position Ps".

The ribbon sensor may be disposed at any suitable position, as long as it can detect each panel boundary. For example, the ribbon sensor may be disposed upstream of the head 3 as viewed in the winding direction of the ink ribbon 4.

In the printer 1, a transmissive color sensor is used as the ribbon sensor 8. The transmissive color sensor is constructed from a combination of a light-projecting ribbon sensor and a light-receiving ribbon sensor disposed opposite each other across the transport path of the ink ribbon 4. The position of the light-projecting ribbon sensor and the position of the light-receiving ribbon sensor may be interchanged.

Though not shown here, either one or the other or both of the ribbon rollers 4A and 4B are equipped with an encoder for detecting the amount of transport of the ink ribbon 4. The ink-ribbon driving unit 34 calculates the amount of feed necessary to position the beginning of each panel to the head position Ph of the head 3, based on the number of pulses from the encoder, the winding diameter of either one or the other or both of the ribbon rollers 4A and 4B, the sensing result from the ribbon sensor 8, etc. The ink-ribbon driving unit 34 positions the beginning of each panel to the head position Ph by transporting the ink ribbon 4 in accordance with the necessary amount of feed.

The length along which an image can be formed on the recording sheet 10 depends on the length of each color region of the ink ribbon 4. When printing an image corresponding to a photograph of L size or 2L size, for example, the printer 1 uses an ink ribbon 4 having a length that matches the L size or 2L size, respectively. However, the printer 1 can form an image whose length is shorter than the length the ink ribbon 4 is capable of printing. For example, if the printer 1 is provided with an ink ribbon for 2L printing, the printer 1 can form an image of L size as well as an image of 2L size.

One or the other of the ribbon rollers 4A and 4B incorporates an RFID tag which stores information such as data on the characteristics of the ink ribbon 4 and the cumulative amount of used ink ribbon (the amount of remaining ink ribbon). The information stored in the RFID tag is used to set up the printing conditions for the printer 1 (the energization conditions for the head 3).

As described above, the printer 1 can also print an image smaller than the panel size of the ink ribbon 4. The following description is given by taking as an example the case where an image whose size is 6×8 inches (152×203 mm) or one-half of it, i.e., 6×4 inches (152×101 mm), is formed using an ink ribbon 4 whose panel size is, for example, 6×8 inches. However, the sizes need not be limited to the above particular sizes, but the following operational example is applicable to any combination of two different sizes one of which is two or more times larger or smaller than the other in terms of area size. Such combination of sizes may include, for example, a combination of A5 size (148×210 mm) and A6 size (105×148 mm) or a combination of 2L size (127×178 mm) and L size (89×127 mm). The size of 6×8 inches will hereinafter be referred to as the "6×8 size" and the size of 6×4 inches the "6×4 size". The 6×8 size is one example of the first size, and the 6×4 size is one example of the second size which is not larger than one-half the first size.

When a command for forming a 6×8 size image is given from the host computer, the printer 1 forms the image on the recording sheet 10 by using the whole area of each 6×8 size panel for yellow, magenta, cyan, and overcoat.

On the other hand, when a command for forming a 6×4 size image is given from the host computer, the printer 1 forms the image on the recording sheet 10 by using the first half or second half portion of each 6×8 size panel for yellow, magenta, cyan, and overcoat along the winding direction (forward direction) of the ink ribbon 4. In this case, if there are no panels with their one-half portions remaining unused due to the formation of a previous 6×4 size image, the printer 1 uses the first half portions of new panels. If there are panels with their one-half portions remaining unused, the printer 1 uses the portions remaining unused (the second half portions of the panels whose first half portions are already used).

When forming a 6×4 size image using the first half portions of new panels, the printer 1 drives the head 3 at a slower speed than when forming a 6×8 size image. More specifically, when forming a 6×4 size image using the first half portions of new panels, the control unit 30 performs control so that the color inks and the overcoat are transferred at a slower speed from the ink ribbon 4 onto the recording sheet by pressing the head 3 against the platen roller 9 with a longer print period than when forming a 6×8 size image. In this way, by printing the image at a slower speed when using the one-half portions of new panels, the printer 1 reduces the damage that the ink ribbon 4 may suffer during the transfer. This serves to prevent creases from occurring in the panels when subsequently forming a 6×4 size image using the unused portions (second half portions) of the panels.

On the other hand, when forming a 6×4 size image using the unused portions (second half portions) of the partially used panels, the head 3 is driven at a slower speed than or at the same speed as when forming a 6×8 size image.

In the printer 1, when a 6×4 size image has been formed using the first half portions of new panels, information indicating that the second half portions of the panels remain unused is stored, for example, in the RFID tag incorporated in one or the other of the ribbon rollers 4A and 4B, in order to enable the half-unused panels to be reused. Then, based on the stored information and the print image size commanded by the host computer, the control unit 30 in the printer 1 determines whether to use new panels or to reuse the half-unused panels by rewinding the ink ribbon 4.

If it is determined by the control unit 30 that new panels are to be used, the ink-ribbon driving unit 34 positions the beginning of a new yellow panel to the head position Ph. On the other hand, if it is determined by the control unit 30 that the half-unused panels are to be reused, the ink-ribbon driving unit 34 drives the rewinding mechanism of the ink ribbon 4 to rewind the ink ribbon 4 until the beginning of the unused portion of the half-unused yellow panel comes to the head position Ph.

FIGS. 3(A) to 3(D) are diagrams for explaining the movement of the ink ribbon 4.

Figure 3:
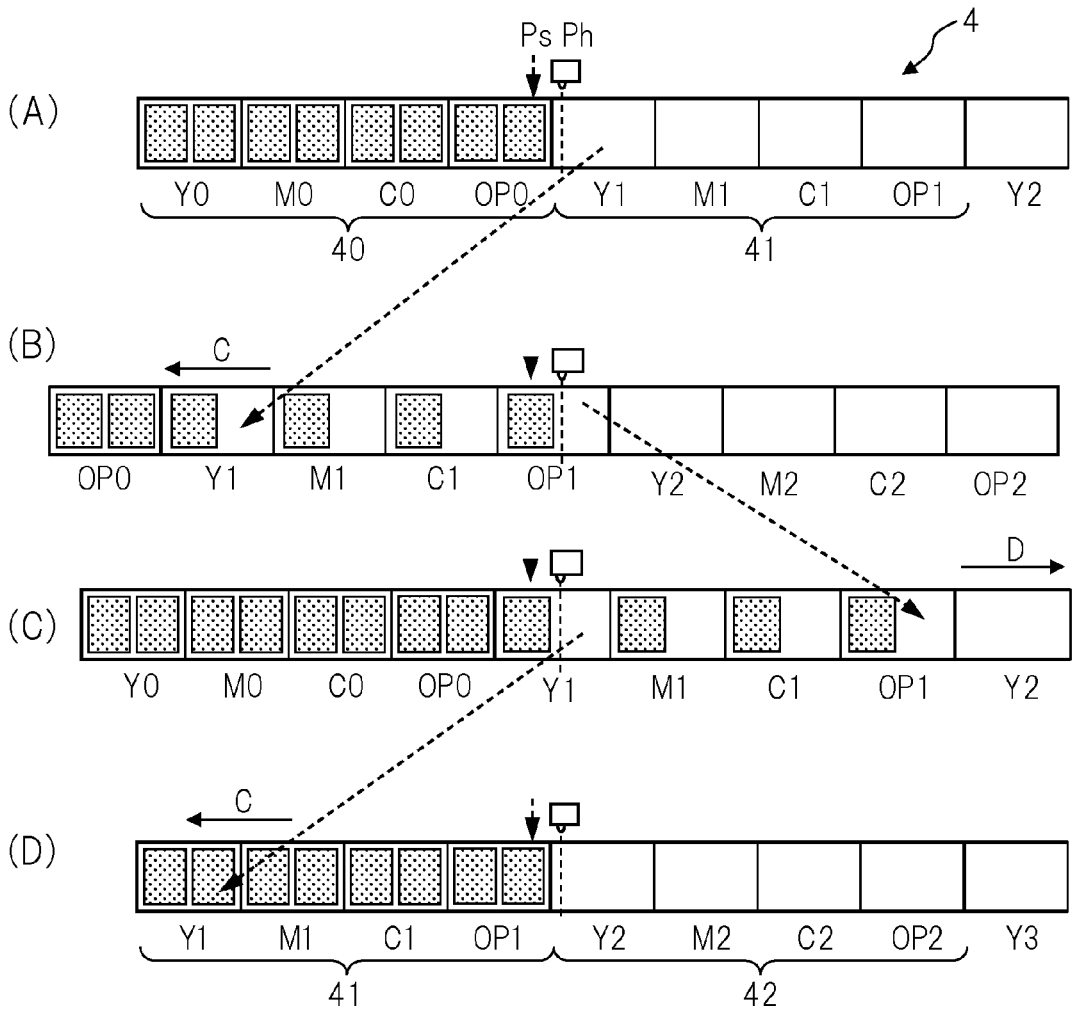
FIGS. 3(A) to (D) are diagrams for explaining the movement of the ink ribbon 4.

FIG. 3(A) shows the ink ribbon 4 which is capable of 6×8 size printing. Regions 40 each indicate a panel whose whole area has already been used, and regions 41 each indicate a panel whose whole area is yet to be used. The regions 40 include the panels of yellow Y0, magenta M0, cyan C0, and overcoat OP0, while the regions 41 include the panels of yellow Y1, magenta M1, cyan C1, and overcoat OP1. It is to be understood that the panels of yellow, magenta, cyan, and overcoat are arranged in this order in a repeated manner in the regions not shown to the left of the regions 40 and to the right of the regions 41. FIG. 3(A) shows the condition when the whole area of each of the panels up to the regions 40 has already been used and when image printing using the regions 41 is about to begin. The beginning of the yellow Y1 is located at the head position Ph.

FIG. 3(B) shows the condition after a 6×4 size image has been formed in accordance with a print command from the host computer by using the first half portions of the panels in the regions 41 as viewed along the direction of arrow C (the forward direction, i.e., the winding direction). During printing, the ink ribbon 4 is transported in the direction of arrow C and wound onto the ribbon take-up roller 4B by the ink-ribbon driving unit 34. As previously described, the formation of a 6×4 size image using the first half portions of new panels for the respective color inks and the overcoat is performed at a slower speed than when forming a 6×8 size image. In the regions 41 containing the panels all of which were unused before printing, the first half portions of the panels along the winding direction are now used, leaving the second half portions unused.

FIG. 3(C) shows the condition before performing printing using the unused second half portions of the panels in the regions 41 along the direction of arrow C in accordance with another 6×4 size image print command received from the host computer. In this case, the ink ribbon 4 is transported in the direction of arrow D (the reverse direction, i.e., the rewinding direction) toward the ribbon supply roller 4A by the ink-ribbon driving unit 34. The ink ribbon 4 is rewound until the beginning of the second half portion of the yellow Y1 whose first half portion has been used in the previous image formation comes to the head position Ph.

FIG. 3(D) shows the condition after the 6×4 size image has been formed using the second half portions of the panels in the regions 41. During printing, the ink ribbon 4 is transported in the direction of arrow C and wound onto the ribbon take-up roller 4B by the ink-ribbon driving unit 34. As previously described, the formation of a 6×4 size image using the second half portions of partially used panels for the respective color inks and the overcoat is performed at a slower speed than or at the same speed as when forming a 6×8 size image. In the regions 41 containing the panels whose one-half portions were unused before printing, the second half portions of the panels along the winding direction are now used, and thus the whole area of each of these panels has been used. After that, the formation of a new image is performed using the panels in the next regions 42.

Figure 4:
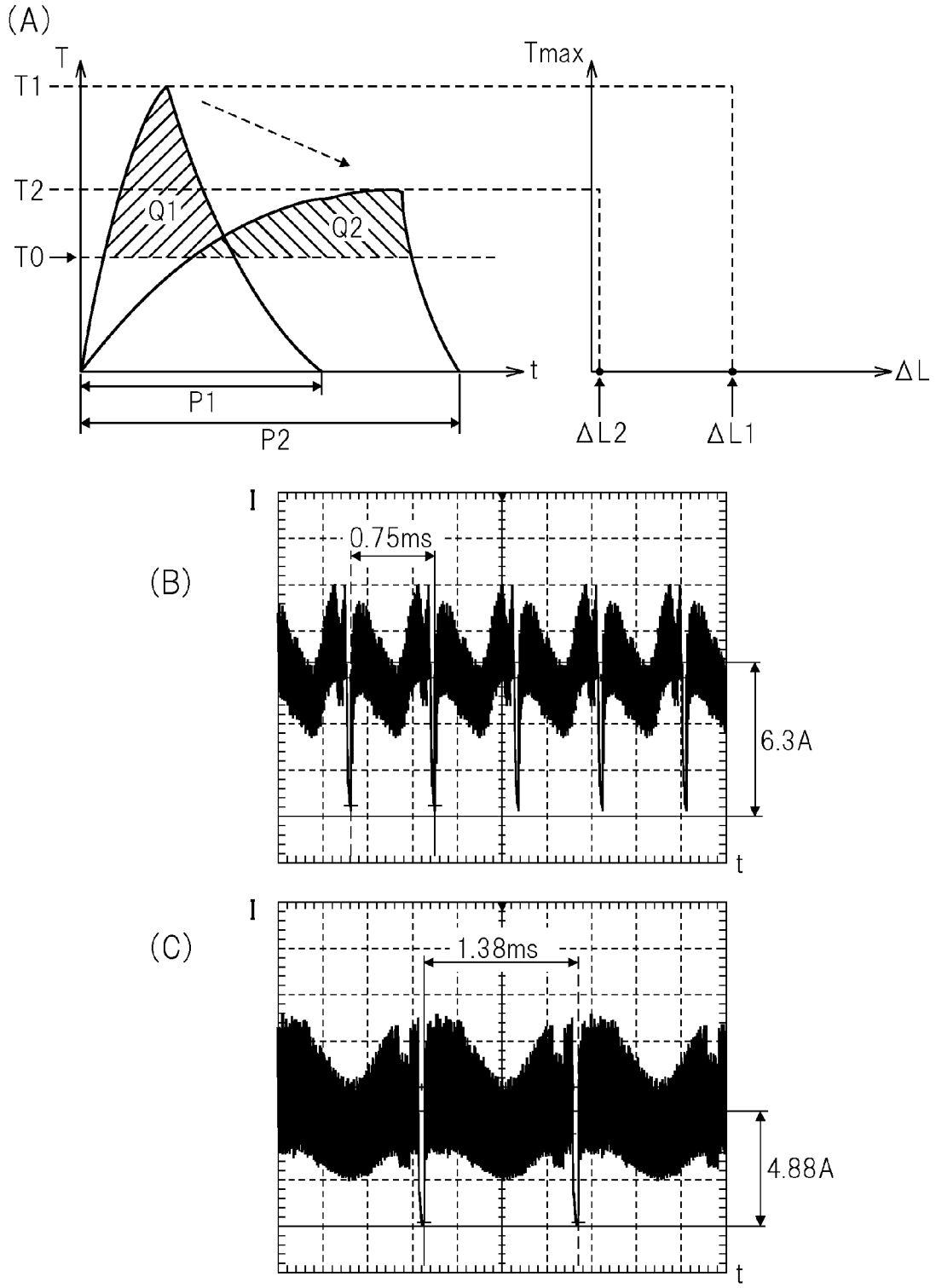
FIGS. 4(A) to (C) show graphs for explaining relationships among printing speed, head temperature, and amount of ribbon elongation, and graphs showing examples of energizing waveforms for the head 3 for the case where printing is performed at the usual speed and the case where printing is performed at a slower speed.

FIG. 4(A) shows graphs for explaining relationships among printing speed, head temperature, and amount of ribbon elongation. The graph at the left in FIG. 4(A) shows one example of the relationship between the elapsed time t during printing and the temperature T of the head 3. The graph at the right in FIG. 4(A) shows one example of the relationship between the maximum temperature Tmax of the head 3 and the amount of panel elongation ΔL. The amount of panel elongation ΔL corresponds to the magnitude of the damage that each panel of the ink ribbon 4 suffers.

P1 is the print period when performing 6×8 size image formation. That is, in the case of 6×8 size image formation, for each of the yellow, magenta, cyan, and overcoat regions, the temperature of the head 3 when the head 3 is pressed against the platen roller 9 varies with the print period P1 as shown in FIG. 4(A). To transfer each color ink (color formation), the head 3 must be heated to or above a certain temperature T0. In the case of 6×8 size image formation, the amount of heat corresponding to the area of Q1 shown in FIG. 4(A) is applied to each panel.

On the other hand, P2 is the print period when performing 6×4 size image formation using the first half portions of new panels. That is, in the case of this 6×4 size image formation, for each of the yellow, magenta, cyan, and overcoat regions, the temperature of the head 3 when the head 3 is pressed against the platen roller 9 is caused to vary with the print period P2 which is longer than P1, as shown in FIG. 4(A). In the case of this 6×4 size image formation, the amount of heat corresponding to the area of Q2 shown in FIG. 4(A) is applied to each panel. Since the energy necessary for color formation is the same regardless of the printing speed, the printing speed and the peak temperature of the head 3 are set so that the amount of heat Q2 is equal to Q1.

As shown in FIG. 4(A), in the printer 1, when forming a 6×4 size image by using new panels, the head 3 heats the new panels at a slower speed and lower temperature than when forming a 6×8 size image. When the printing speed is high, a large amount of heat must be instantaneously applied by raising the peak temperature of the head 3 (as indicated at T1 in FIG. 4(A)) in order to obtain the energy necessary for color formation. On the other hand, when the printing speed is low, even if the peak temperature of the head 3 is reduced (as indicated at T2 in FIG. 4(A)), the energy necessary for color formation can be obtained because the same amount of heat can be applied by heating for a longer time.

FIGS. 4(B) and 4(C) are graphs showing examples of energizing waveforms for the head 3, the former for the case where printing is performed at the usual speed and the latter for the case where printing is performed at a slower speed. That is, FIG. 4(B) shows the graph when printing is performed with the print period P1, and FIG. 4(C) shows the graph when printing is performed with the print period P2. In each graph, the ordinate represents the current I for heating the head 3, and the abscissa represents the time t. Since the energization is done by driving a chopper, the waveform is a band-like waveform. As shown in FIG. 4(B), in the case of printing at the usual speed, one line period is 0.75 ms, and the average current is 6.3 A. On the other hand, as shown in FIG. 4(C), in the case of printing at a slower speed, the average current is reduced to 4.88 A by setting one line period as slow as 1.38 ms, and each panel of the ink ribbon 4 is heated at a lower temperature than in the case of printing at the usual speed.

As the temperature of the head 3 rises, greater damage is caused to the ink ribbon 4, and hence the amount of ribbon elongation increases. However, as shown in FIG. 4(A), the amount of elongation, ΔL2, of each panel at the lower peak temperature T2 of the head 3 is smaller than the amount of elongation, ΔL1, of each panel at the higher peak temperature T1 of the head 3. As a result, when forming a 6×4 size image by using new panels, the printing speed is reduced to reduce the peak temperature so that the amount of elongation that may be introduced in the half-unused panels can be reduced.

Further, in the printer 1, when forming a 6×4 size image by using new panels, the head 3 applies the same amount of heat per unit area to each new panel as when forming a 6×8 size image (that is, Q1=Q2). To achieve this, the control unit 30 detects changes in the temperature of the head 3 in real time by using a temperature sensor (thermistor), and controls the heater (heating elements) of the head 3 to change the temperature of the head 3 in near real time. Generally, when the printing speed is changed, the hue of the resulting image also changes, but by controlling the heating temperature of the head 3 (the amount of heat) as described above, the color characteristics are prevented from changing when the printing speed is reduced.

The formation of a 6×4 size image using the unused portions (second half portions) of the partially used panels is performed with the longer print period P2 than the formation of a 6×8 size image or with the same print period P1 as the formation of a 6×8 size image. In particular, in order that the print quality (hue, etc.) of the 6×4 size image printed using the first half portions of the panels and that of the 6×4 size image printed using the second half portions of the panels may match with each other, it is recommended that the formation of the 6×4 size image using the unused portions of the partially used panels be performed with the longer print period P2 than the formation of a 6×8 size image. When the formation of the 6×4 size image using the unused portions of the partially used panels is performed with the print period P2, each of the partially used panels is also heated at a lower temperature than when forming a 6×8 size image. Further, when forming the 6×4 size image by using the unused portions of the partially used panels, the head 3 also applies the same amount of heat per unit area to each of the partially used panels as when forming a 6×8 size image.

Figure 5:
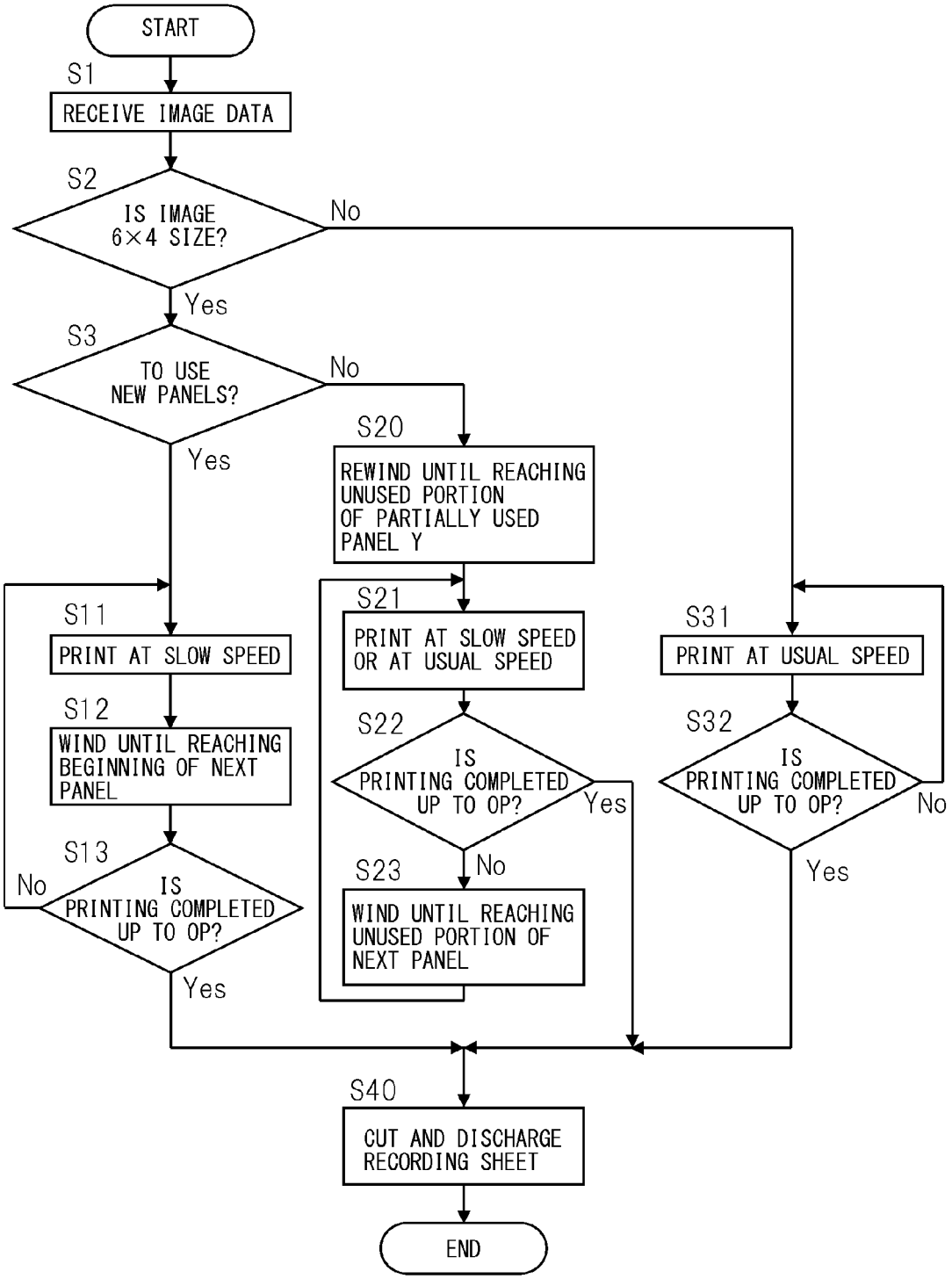
FIG. 5 is a flowchart illustrating one operational example of the printer 1.

FIG. 5 is a flowchart illustrating one operational example of the printer 1. The flow shown in FIG. 5 is performed under the control of the CPU in the control unit 30 in accordance with a program prestored in the ROM in the control unit 30. It is assumed that a 6×8 size ink ribbon 4 is mounted in the printer 1.

First, the printer 1 receives a print command and print image data from the host computer (S1). Then, the control unit 30 examines to determine whether the image data is 6×4 size or not (S2). If the image data is not 6×4 size but is, for example, 6×8 size (No in S2), the process proceeds to S31 to be described later. If the image data is an image larger in size than the a 6×8 size panel, error processing (not shown) is performed.

If the image data is 6×4 size (Yes in S2), the control unit 30 proceeds to determine whether to use new panels or to reuse half-unused panels by rewinding the ink ribbon 4 by referring to information stored in the printer, for example, that indicates the presence or absence of half-unused panels (S3).

If it is determined that new panels are to be used, that is, if there are no half-unused panels (Yes in S3), the head 3 performs image formation, as shown in FIG. 3(B), at a slow printing speed by using one panel (first, the yellow Y) (S11). More specifically, the recording-sheet driving unit 32 feeds the recording sheet 10 to match the size of the image recording area on the recording sheet 10. Further, the head driving unit 33 moves the head 3 to press it against the platen roller 9. Then, while rewinding the recording sheet 10 fed by the recording-sheet driving unit 32, an image for one color (first, the yellow Y) is formed by the head 3 with the print period P2 shown in FIG. 4(A). At this time, the ink ribbon 4 is also moved. The rewinding of the recording sheet 10, the winding of the ink ribbon 4, and the image formation by the head 3 are performed in synchronized fashion. When the image formation for one color is completed, the head driving unit 33 moves the head 3 away from the platen roller 9.

The ink-ribbon driving unit 34 winds the ink ribbon 4 until the beginning of the next color panel (the second color is the magenta M) comes to the head position Ph (S12). Then, the control unit 30 checks to see if printing up to the overcoat OP is completed or not (S13). If printing up to the overcoat OP is not completed yet (No in S13), the process returns to S11, and image formation is performed for the magenta M, the cyan C, and the overcoat OP, respectively, in the same manner as for the yellow Y. In this way, the color images of the yellow Y, the magenta M, and the cyan C are sequentially formed on the same image forming area on the recording sheet 10, and the overcoat layer is applied to form a protective layer. When printing up to the overcoat OP is completed (Yes in S13), the process proceeds to S40.

On the other hand, if it is determined by the control unit 30 that half-unused panels are to be reused (No in S3), the ink-ribbon driving unit 34 rewinds the ink ribbon 4 until the beginning of the unused second half portion of the partially used yellow panel Y comes to the head position Ph, as shown in FIG. 3(C) (S20). In this case, the ink-ribbon driving unit 34 calculates the necessary amount of feed based on the pitch of each panel, the number of pulses from the encoder, the winding diameter of either one or the other or both of the ribbon rollers 4A and 4B, etc., and rewinds the ink ribbon 4 in the direction of arrow D in accordance with the thus calculated amount of feed.

Next, the head 3 performs image formation, as shown in FIG. 3(D), at a slow printing speed or at the usual printing speed by using one panel (first, the yellow Y) (S21). The processing performed here is the same as that of the above-described S11, except that, in the case of the usual printing speed, an image for each color is formed by the head 3 with the print period P1 shown in FIG. 4(A). After that, the control unit 30 checks to see if printing up to the overcoat OP is completed or not (S22). If printing up to the overcoat OP is not completed yet (No in S22), the ink-ribbon driving unit 34 winds the ink ribbon 4 until the beginning of the unused second half portion of the next color panel (the second color is the magenta M) comes to the head position Ph (S23).

Then, the process returns to S21, and image formation is performed for the magenta M, the cyan C, and the overcoat OP, respectively, in the same manner as for the yellow Y. In this way, the printer 1 sequentially forms the color images of the yellow Y, the magenta M, and the cyan C on the same image forming area on the recording sheet 10, and the overcoat layer is applied to form a protective layer. When printing up to the overcoat OP is completed (Yes in S22), the process proceeds to S40.

If the print image data is not 6×4 size, that is, if it is 6×8 size (No in S2), the head performs image formation in the same manner as in the above-described S21 at the usual print speed (that is, with the print period P1 shown in FIG. 4(A)) by using the whole area of each new panel (S31). When printing up to the overcoat OP is completed (Yes in S32), the process proceeds to S40.

When the printing ends, the recording-sheet driving unit 32 feeds the recording sheet 10, and the recording-sheet cutting unit 5 cuts the recording sheet 10, which is discharged out through the exit port 6 (S40). The printer 1 then terminates the printing process.

As has been described above, when printing a 6×4 size image by using one half portions of new 6×8 size panels, the printer 1 sets the printing speed slower than usual and thereby reduce the damage that may be caused to the half-used panels. This prevents creases from occurring in the panels when subsequently forming a 6×4 size image by rewinding the ink ribbon 4 and using the unused portions of the panels.

Furthermore, this allows the printer 1 to use the remaining unused portions of the panels for the formation of a new image, even after forming a high-density image by partially using the panels. Since the printer 1 does not determine whether to reuse or not to reuse the panels based on the density of the previously printed image, the printer 1 does not waste the panels by determining not to reuse the half-unused panels, and can print as many images as the remaining unused portions of the panels allow.

In the printer 1, since the damage that may be caused to partially used panels can be reduced, the first areas to be used when printing a 6×4 size image by using new panels need not be limited to the second half portions of the new panels. The above description has been given by dealing with the case where, when performing 6×4 size printing using new panels, each panel is used starting from its first half portion along the transport direction of the ink ribbon 4, but either the first half portion or the second half portion may be used first.

REFERENCE SIGNS LIST

1 printer
2 roll paper holder
3 head
4 ink ribbon
4A ribbon supply roller
4B ribbon take-up roller
8 ribbon sensor
9 platen roller
10 recording sheet
30 control unit
Ph head position
Ps sensor position

What is claimed is:

1. An image forming apparatus comprising:

a transporting unit which transports a belt-like transfer medium on which a plurality of transfer material regions of a first size respectively corresponding to a plurality of transfer materials are arranged in a predetermined order in a repeated manner along a longitudinal direction thereof; and an image forming unit which transfers the transfer materials in sequence by heating the respective transfer material regions and thereby forms on a recording medium an image with the first size or an image with a second size which is not larger than one half the first size, wherein when forming an image with the second size, the image forming unit either uses unused portions of transfer material regions that have already been used to form an image with the second size or uses new transfer material regions on the transfer medium, and when forming the image with the second size by using the new transfer material regions and when forming the image with the second size by using the unused portions of the transfer material regions that have already been used to form an image with the second size, the image forming unit performs the image formation at the same speed which is slower than when forming an image with the first size.

2. The image forming apparatus according to claim 1, wherein when forming the image with the second size at a slower speed than when forming an image with the first size, the image forming unit heats each of the transfer material regions at a lower temperature than when forming an image with the first size.

3. The image forming apparatus according to claim 2, wherein when forming the image with the second size, the image forming unit applies the same amount of heat per unit area to each of the transfer material regions as when forming an image with the first size.

4. The image forming apparatus according to claim 1, wherein when forming the image with the second size by using the new transfer material regions, the image forming unit uses a first half portion of each of the transfer material regions as viewed along a transport direction of the transfer medium.

5. An image forming method comprising:

a transporting step for transporting a belt-like transfer medium on which a plurality of transfer material regions of a first size respectively corresponding to a plurality of transfer materials are arranged in a predetermined order in a repeated manner along a longitudinal direction thereof; and an image forming step for transferring the transfer materials in sequence by heating the respective transfer material regions and thereby forming on a recording medium an image with the first size or an image with a second size which is not larger than one half the first size, wherein in the image forming step, when forming an image with the second size, the image is formed either using unused portions of transfer material regions that have already been used to form an image with the second size or using new transfer material regions on the transfer medium, and when forming the image with the second size by using the new transfer material regions and when forming the image with the second size by using the unused portions of the transfer material regions that have already been used to form an image with the second size, the image formation is performed at the same speed which is slower than when forming an image with the first size.

* * * * *